US006880964B1

(12) United States Patent
Yang

(10) Patent No.: US 6,880,964 B1
(45) Date of Patent: Apr. 19, 2005

(54) CHAIN-CONTROLLED LAMP STAND WITH MULTI-STAGE LIGHT MODULATION

(75) Inventor: Wen Ho Yang, Taipei Hsien (TW)

(73) Assignee: Sun Lite Sockets Industry Inc., Taoyuan Hsien (TW)

( * ) Notice: Subject to any disclaimer, the term of this patent is extended or adjusted under 35 U.S.C. 154(b) by 0 days.

(21) Appl. No.: 10/694,782

(22) Filed: Oct. 29, 2003

(51) Int. Cl.[7] ..... F21S 4/00; F21V 9/16
(52) U.S. Cl. ..... 362/802; 362/251; 315/58
(58) Field of Search ..... 315/55, 60; 362/84, 362/228, 229, 251, 249, 184, 802, 806

(56) References Cited

U.S. PATENT DOCUMENTS 5,731,663 A * 3/1998 Davis ..... 315/58
6,168,282 B1 * 1/2001 Chien ..... 362/251
6,273,580 B1 * 8/2001 Coleman et al. ..... 362/802

* cited by examiner

*Primary Examiner*—Wilson Lee
(74) *Attorney, Agent, or Firm*—Bacon & Thomas PLLC

(57) ABSTRACT

A chain controlled lamp stand with multi-stage light modulation includes a control device to modulate brightness of a lamp. The control device consists of a chain-controlled switch and a light modulation circuit board controlled by the chain-controlled switch to modulate the brightness of the lamp. The chain-controlled switch in the lamp stand is combined with a rotatable disc, which can be actuated to rotate at its original location by a pull chain. The rotable disc is assembled thereon with a conducting metal contact strip, and the light modulation circuit board is provided with multi-stage connecting strips, which are able to change, and control voltage waveform. Thus, the metal contact strip is actuated to contact respectively with the multi-stage connecting strips to carry out multi-stage light modulation of the lamp stand.

2 Claims, 9 Drawing Sheets

CHAIN-CONTROLLED LAMP STAND WITH MULTI-STAGE LIGHT MODULATION

BACKGROUND OF THE INVENTION

1. Field of the Invention

This invention relates to a chain-controlled lamp stand with multi-stage light modulation, particularly to one having a multi-stage light modulating device provided inside a lamp stand, needless to install an additional light modulating controller outside the lamp stand.

2. Description of the Prior Art

A conventional chain-controlled lamp stand is provided with a chain pulled to turn on and off a light, but the conventional lamp stand itself cannot carry out multi-stage light modulation. Therefore, a light-modulating controller has to be additionally provided outside the conventional chain-controlled lamp stand in order to carry out multi-stage light modulation, thus enlarging whole dimensions, spoiling esthetical appearance and increasing cost.

SUMMARY OF THE INVENTION

The objective of the invention is to offer a chain-controlled lamp stand with multi-stage light modulation, having a multi-stage light modulating device with a chain-controlled switch provided inside a lamp stand and needless to install an additional light-modulating controller outside the lamp stand.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
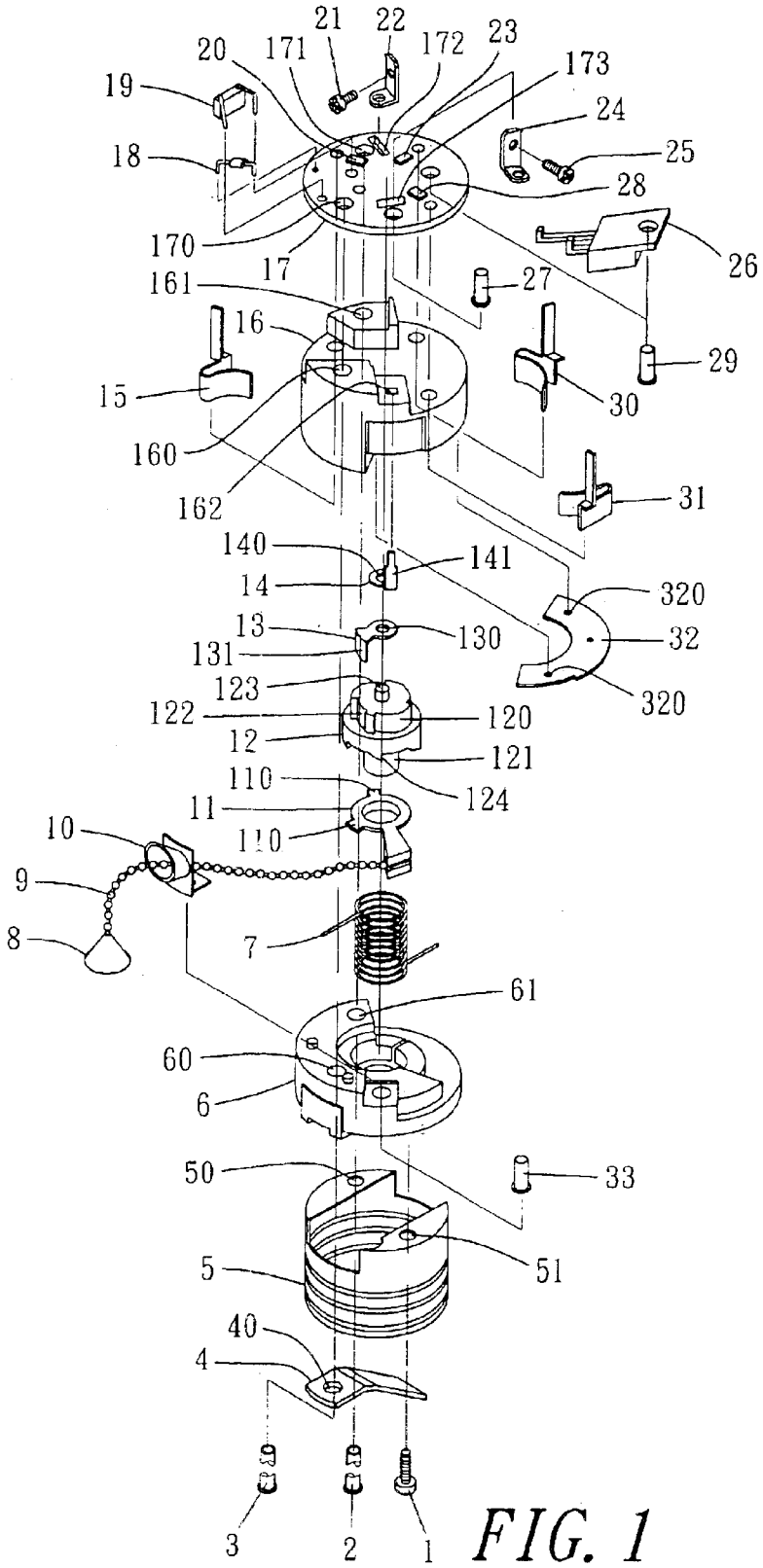
FIG. 1 is an exploded perspective view of a first preferred embodiment of a chain-controlled lamp stand with multi-stage light modulation in the present invention.

A first preferred embodiment of a chain-controlled lamp stand with multi-stage modulation in the present invention, as shown in FIG. 1, includes a first fastening member 1 (such as an automatically-driven bolt), a second fastening member 2 (such as a rivet), a third fastening member 3 (such as a rivet), a center tongue 4, an circular holder 5, a first base 6, a compression spring 7, a bell-shaped member 8, a pull chain 9, a bell-shaped base 10, a rotatable disc 11 (having protruding teeth 110 on the edge), a rotatable rod 12 (having its upper and lower ends respectively provided with a stud 120, 121, with the lower stud 121 fitted with the rotatable disc 11 and provided with projecting teeth 124 to be meshed with the projecting teeth 110 of the rotatable disc 11, with the upper stud 120 having it upper surface bored with a recessed teeth groove 122 having a small projecting member 123 on the topside), a first contact strip 13 (having a central insert hole 130 and formed with a bent arc-shaped portion 131), a second contact strip 14 (having a central portion 141), a first connecting strip 15, a second base 16, a light modulation circuit board 17 (having a double-sided printed circuit), a DIAC 18, a capacitor 19, a first resistance 20 (R1), a first line-connecting screw 21, a first line-connecting base 22, a second resistance 23 (R2), a second line-connecting base 24, a second line-connecting screw 25, a TRIAC, a fourth fastening member 27 (such as a rivet), a third resistance 28 (R3), a fifth fastening member 29 (such as a rivet), a second connecting strip 30, a third connecting strip 31, an insulation spacer 32 (having its opposite ends respectively bored with a position hole 320), and a sixth fastening member 33 (such as a rivet). The first resistance 20 (R1), the second resistance 23 (R2) and the third resistance 28 (R3) are soldered through a mode of SMT (Surface Mount Technology).

The structure and assembly of above-mentioned components are described below.

The circular holder 5 and the center tongue 4 are respectively connected with two electrodes of a lamp so that when the switch is ON, the lamp is connected with power.

The third fastening member 3 is orderly inserted through the insert hole 40 of the center tongue 4, the first insert hole 60 of the first base 6, the first insert hole 160 of the second base 16 and the first insert hole 170 of the light modulation circuit board 17 to firmly combine these components together.

The second fastening member 2 is orderly inserted through the first insert hole 50 of the circular holder 5, the second insert hole 61 of the first base 6, the second insert hole 161 of the second base 16 and the second insert hole 171 of the light modulation circuit board 17 to firmly combine these components together, only the first line-connecting base 22 has to be inserted through the grooved hole 172 of the light modulation circuit board 17 before assembling the second fastening member 2.

The first fastening member 1 is inserted through the second insert hole 51 of the circular holder 5 and the grooved hole (not shown) of the first base 6 and then firmly screwed with the first base 6 to fix the circular holder 5 in position.

Thus, the circular holder 5 and the first line-connecting base 22 is connected with each other by the second fastening member 2; therefore the printed circuit on the light modulation circuit board 17 can make the first line-connecting base 22 contacted with the second fastening member 2 to let one of two power lines connected with the first line-connecting base 22 by the first line-connecting screw 21, and the other power line makes the third fastening member 3 connected with the center tongue 4 by the electronic switch of the light modulation circuit board 17 of the second line-connecting base 24.

The compression spring 7 has one end fixed on the first base 6 and the other end inserted through the lower stud 121 of the rotatable rod 12 to force the rotatable disc 11 closely push against the rotatable rod 12, letting the compression spring 7 and the rotatable disc 11 positioned to face each other.

The pull chain 9 has one end fixed on the rotatable disc 11 and the other end inserted through the bell-shaped base 10 to be connected with the bell-shaped member 8. The bell-shaped base 10 is fixedly positioned on the first base 6 by the sixth fastening member 33.

The first contact strip 13 is positioned on the rotatable rod 12 by fitting its central insert hole 130 around the small projecting member 123 of the upper stud 120 of the rotatable rod 12, having its arc-shaped portion 131 positioned in the teeth groove 122 of the upper stud 120 on the rotatable rod 12. Thus, the first contact strip 13 can be firmly positioned to conduct electricity stably when it rotates together with the rotatable rod 12 and contacts with the first, the second and the third connecting strip 15, 30 and 31.

The second contact strip 14 has its insert hole 140 fitted around the small projecting member 123 of the stud 120 of the rotatable rod 12, letting the second contact strip 14 slidably positioned on the first contact strip 13. The second contact strip 14 has its upper vertical portion 141 inserted through the third insert hole 162 of the second base 16 and in the lengthwise through hole of the fourth fastening member 27 and soldered therein.

The first, the second and the third connecting strip 15, 30 and 31 have their lower portions positioned in the second base 16, and their upper portions are inserted through the second base 16 and soldered on the light modulation circuit board 17.

The insulation spacer 32 has its two position holes 320 respectively fitted with two projecting members (not shown) provided under the second base 16 and then fixed thereon with glue. Thus, the insulation spacer 32 can completely insulate the exposed metallic members from the switching element so as to prevent a user of the lamp stand from shock.

The capacitor 19, the first resistance 20 (R1), the second resistance 23 (R2) and the third resistance 28 (R3) are soldered on the light modulation circuit board 17, and the second line-connecting base 24 is inserted through the grooved hole 173 of the light modulation circuit board 17 and fixed thereon by the fourth fastening member 27.

The TRIAC 26 is fixed on the light modulation circuit board 17 by the fifth fastening member 29, having its two feet soldered on the light modulation circuit board 17.

A chain-controlled switch in this preferred embodiment is composed of the compression spring 7, the bell-shaped member 8, the pull chain 9, the bell-shaped base 10, the rotatable disc 11, the rotatable rod 12, the first contact strip 13 and the second contact strip 14. When the pull chain 9 is pulled, the rotatable disc 11 will be actuated to rotate and the projecting teeth 110 on the rotatable disc 11 and the projecting teeth 124 of the rotatable rod 12 meshed together will actuate the first contact strip 13 on the rotatable rod 12 to rotate. Thus, when the pull chain is pulled repeatedly, the first contact strip 13 will be moved to different positions in the second base 16, and the lamp stand will be connected with circuit for multi-stage light modulation or disconnected to form open circuit, as shown in FIGS. 2 to 5. In addition, the upper protruding-out end of the compression spring 7 is able to force the rotatable disc 11 to quickly recover its original position after the rotatable disc 11 is turned around, enabling the chain-controlled switch to be operated repeatedly.

In accordance with the above-mentioned device in the first preferred embodiment, the conditions of multi-stage light modulation of the lamp stand are specifically described below.

Figure 2:
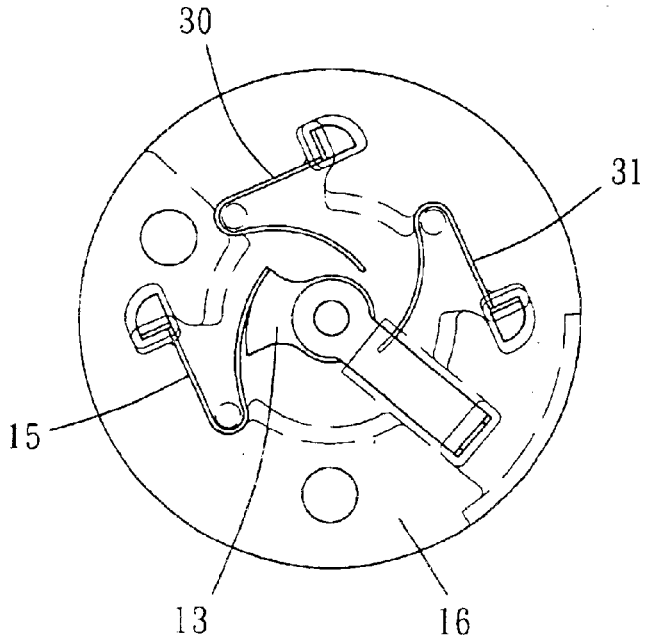
FIG. 2 is an upper view of the first preferred embodiment of the second base of a chain-controlled lamp stand with multi-stage light modulation in the present invention, showing a first condition of a metal strip contacting with one connecting strip of a light modulation circuit board.
Figure 6:
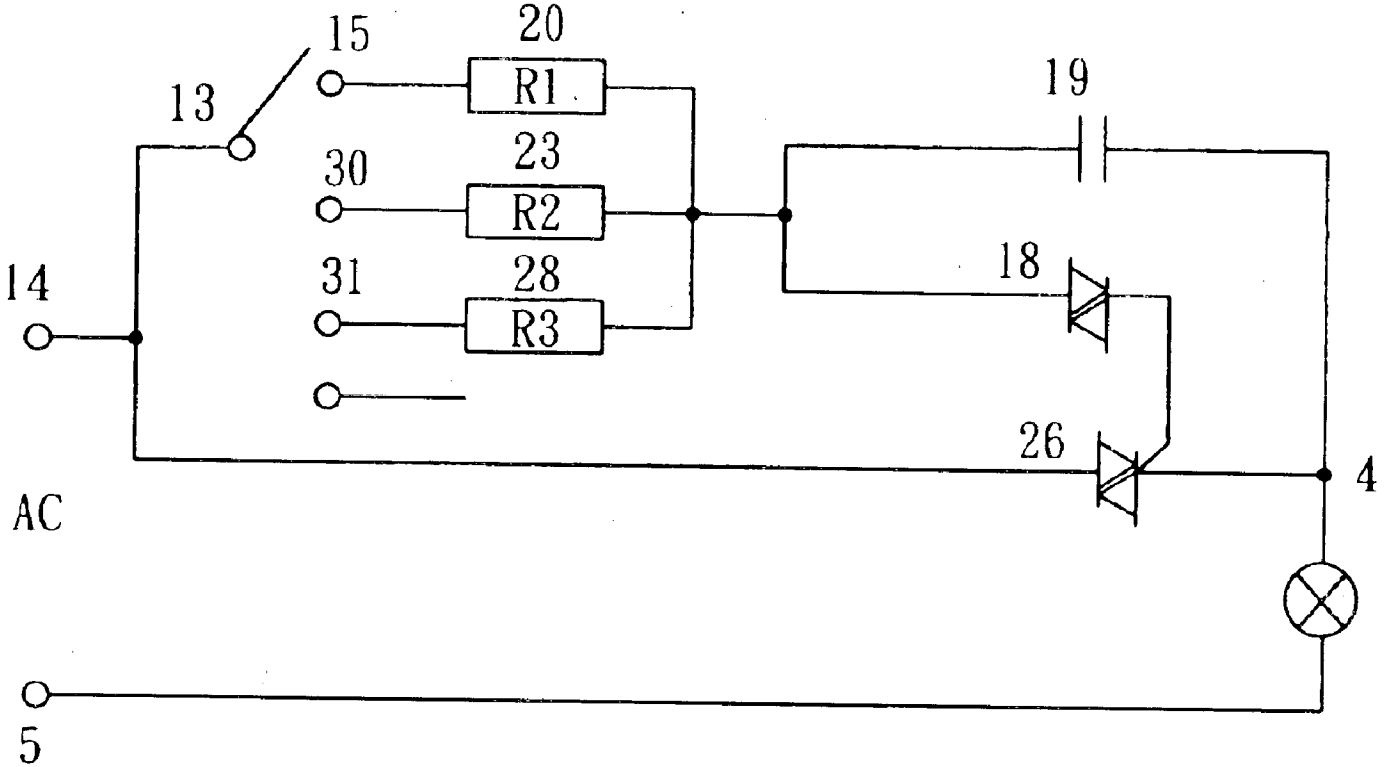
FIG. 6 is a circuit diagram of the first preferred embodiment of the light modulation circuit board of a chain-controlled lamp stand with multi-stage light modulation in the present invention.

(A). A condition of high brightness: when the first contact strip 13 positioned in the second base 16 is moved to contact with the first connecting strip 15, as shown in FIG. 2, electric current will pass through the second contact strip 14 and the first contact strip 13 and then connect with the first connecting strip 15. At this time, the first resistance 20 (R1) will control the capacitor 19 to charge and discharge to control the TRIAC 26 to intercept wave, as shown in FIG. 6 (a circuit diagram of light modulation of the lamp stand), thus letting the lamp shine brightly.

Figure 3:
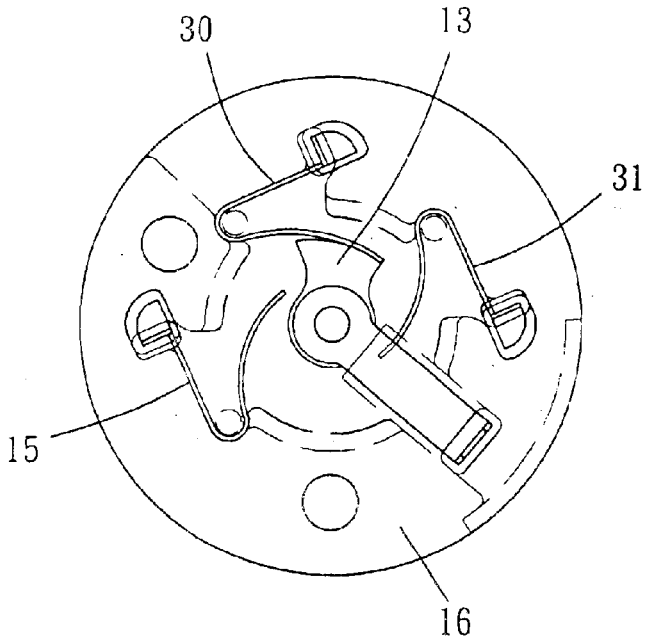
FIG. 3 is an upper view of the first preferred embodiment of the second base of a chain-controlled lamp stand with multi-stage light modulation in the present invention, showing a second condition of the metal strip contacting with another connecting strip of the light modulation circuit board.

(B). A condition of medium brightness: when the first contact strip 13 positioned in the second base 16 is moved to contact with the second connecting strip 30, as shown in FIG. 3, electric current will pass through the second contact strip 14 and the first contact strip 13 and then connect with the second connecting strip 30. At this time, the second resistance 23 (R2) will control the capacitor 19 to charge and discharge to control the TRIAC 26 to intercept wave, as shown in FIG. 6 (the circuit diagram of light modulation of the lamp stand), thus letting the lamp shine with medium brightness.

Figure 4:
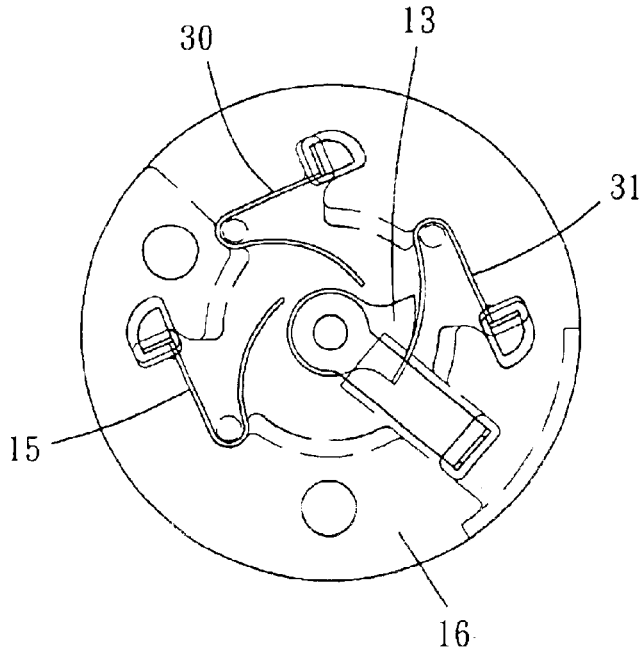
FIG. 4 is an upper view of the first preferred embodiment of the second base of a chain-controlled lamp stand with multi-stage light modulation in the present invention, showing a third condition of the metal strip contacting with the other connecting strip of the light modulation circuit board.

(C). A condition of low brightness: when the first contact strip 13 positioned in the second base 16 is moved to contact with the third connecting strip 31, as shown in FIG. 4, electric current will pass through the second contact strip 14 and the first contact strip 13 and connect with the third connecting strip 31. At this time, the third resistance 28 (R3) will control the capacitor 19 to charge and discharge to control the TRIAC 26 to intercept wave, as shown in FIG. 6 (the circuit diagram of light modulation of the lamp stand), thus letting the lamp shine with low brightness.

Figure 5:
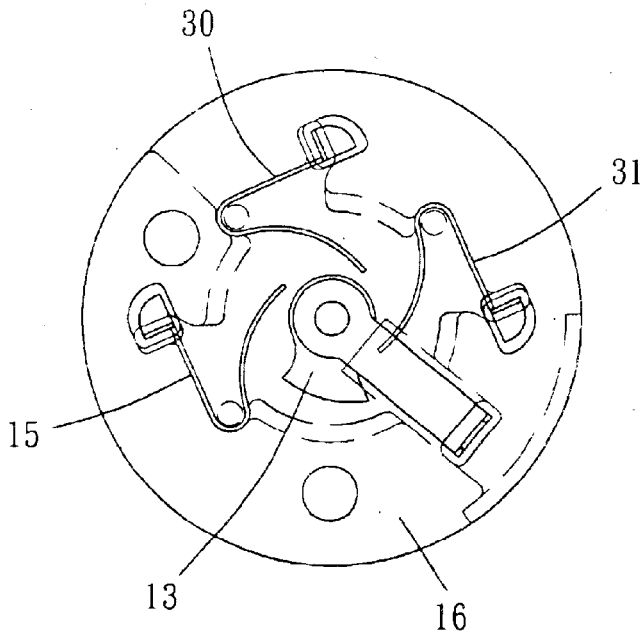
FIG. 5 is an upper view of the first preferred embodiment of the second base of a chain-controlled lamp stand with multi-stage light modulation in the present invention, showing the metal strip not contacting with any connecting strip of the light modulation circuit board.

(D). A turned-off condition of the lamp: when the first contact strip 13 positioned in the second base 16 does not contact with any connecting strip, as shown in FIG. 5, electric current is disconnected and the lamp does not shine.

As can be noted from the above description, this invention has the following advantages.

1. Electronic elements are adopted to control voltage waveform to carry out light modulation, and the light modulation circuit board 17 provided with double-sided printed circuit enables the electronic elements to be soldered and positioned on the two surfaces of the light modulation circuit board, diminishing the dimensions of the lamp stand.

2. The first resistance 20 (R1), the second resistance 23 (R2) and the third resistance 28 (R3) are respectively soldered by a mode of SMT (surface mount technology), able to enhance processing efficiency and low processing cost.

3. It is structured stably and has great capacity of insulation and high utilization in industry.

Figure 7:
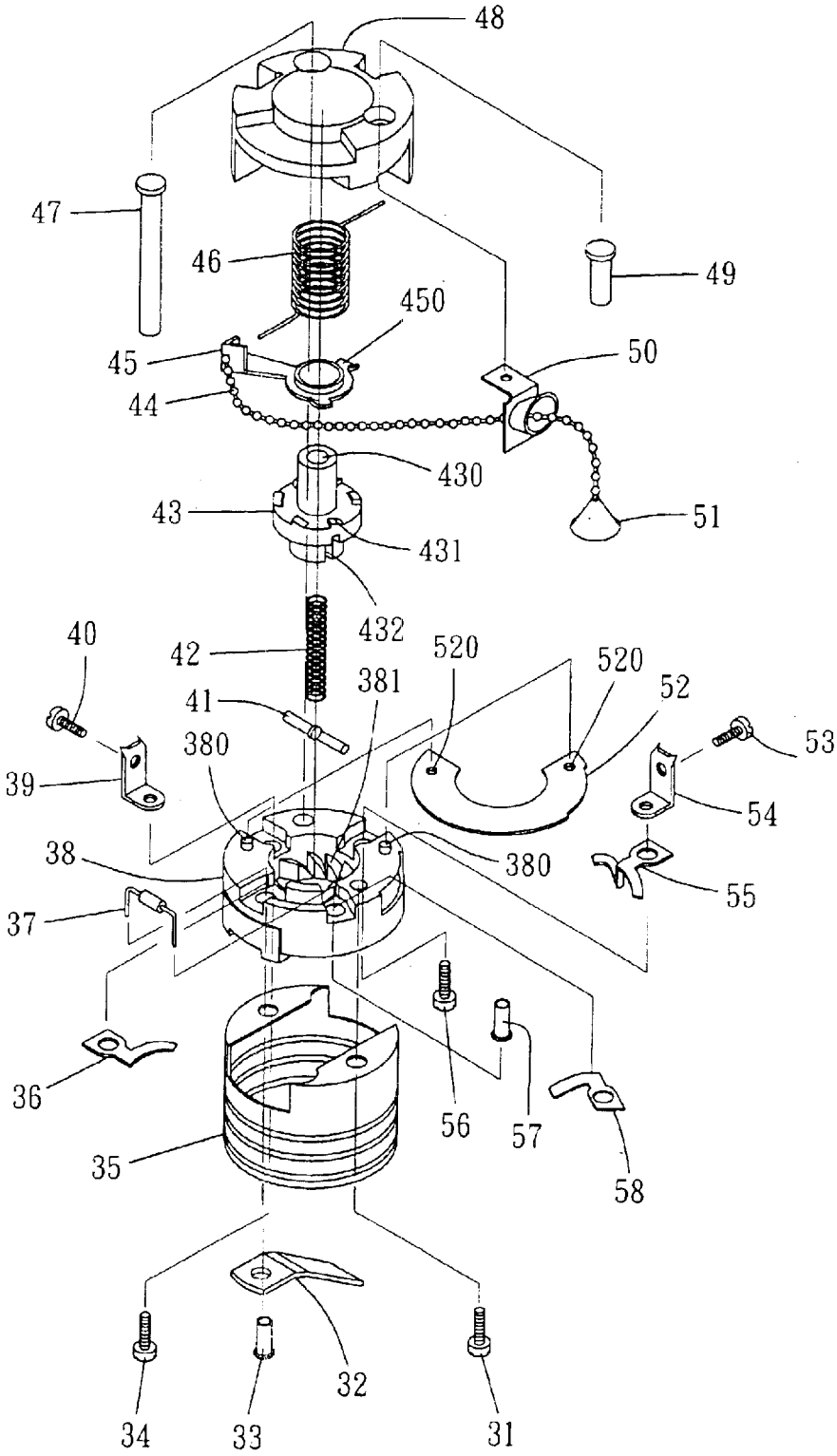
FIG. 7 is an exploded perspective view of a second preferred embodiment of a chain-controlled lamp stand with multi-stage light modulation in the present invention.

A second preferred embodiment of a chain-controlled lamp stand with multi-stage light modulation in the present invention, as shown in FIG. 7, includes a first fastening member 31 (such as an automatically-driven screw), a center tongue 32, a second fastening member 33 (such as a rivet), a third fastening member 34 (such as an automatically-driven screw), a circular holder 35, a first contact strip 36, a diode 37, a first base 38 (having two position studs 38 and formed at the upper central surface with a six-helical-teeth groove 381), a first line-connecting base 38, a first line-connecting screw 40, a rotary metal bar 41, a press reed 42, a rotatable rod 43 (having a central through hole 430 and a plurality of projecting teeth 431 around the circumferential edge), a pull chain 44, a rotatable disc 45 (having plural projecting teeth 45 around the edge), a torque spring 46, a fourth fastening member 47 (such as a rivet), a second base 48, a fifth fastening member 49 (such as a rivet), a bell-shaped base 50, a bell-shaped member 51, an insulation spacer 52 (having its opposite ends respectively bored with a position hole 520), a second line-connecting screw 53, a second line-connecting base 54, a conjugated contact strip 55, a sixth fastening member 56 (such as an automatically-drive screw), a seventh fastening member 57 (such as a rivet) and a second contact strip 58.

The structure and the assembly of the above-mentioned components are described below.

The circular holder 35 and the center tongue 32 are respectively connected with two electrodes of a lamp so that when the switch is ON, the lamp is connected with power.

The center tongue 32 and the first contact strip 36 are fixedly assembled on the first base 38 by the second fastening member 33, and the circular holder 35 and the first line-connecting base 39 are fixedly assembled on the first base 38 by the third fastening member 34, with a power zero line connected with the first line-connecting base 39 through the first line-connecting screw 40. The first fastening member 31 is inserted through the through hole of the circular holder 35 and screwed firmly on the first base 38 to fix the circular holder 35 in position.

The second contact strip 58 is fixed with the first base 38 by the seventh fastening member 57, and the conjugated contact strip 55 and the second line-connecting base 54 are firmly fixed on the first base 38 by the sixth fastening member 56, with a power phase line connected with the second line-connecting base 54 through the second line-connecting screw 53. The insulation spacer 52 has its two position holes 520 respectively fitted on the two position studs 380 of the first base 38, which are respectively inserted and positioned in two insert holes (not shown) of the second base 48, letting the insulation spacer 52 fixed between the first and the second base 38 and 48. Thus, the insulation spacer 52 can insulate the live portion of the first contact strip 36 and the diode 37 and the second contact strip 38 from switch elements so as to prevent a user of the lamp stand from getting electric shock.

The rotary metal bar 41 is positioned in the six helical teeth grooves 381 in the upper central side of the first base 38, and the corresponding spring 42 positioned in the through hole 430 of the rotatable rod 43 enables the rotary metal bar 41 to quickly contact with or separate from the first contact strip 36, the conjugated contact strip 55 and the second contact strip 58. The pull chain 44 has one end secured on the movable disc 45 and the other end inserted through the bell-shaped base 50 and connected with the bell-shaped member 51. The torque spring 46 has one end pressing the rotatable disc 45 to closely push against the rotatable rod 43 and the other end assembled in the second base 48. The bell-shaped base 50 is firmly fixed on the second base 48 by the fifth fastening member 49, and the first base 38 and the second base 48 are fixedly combined together by the fourth fastening member 47.

Figure 8:
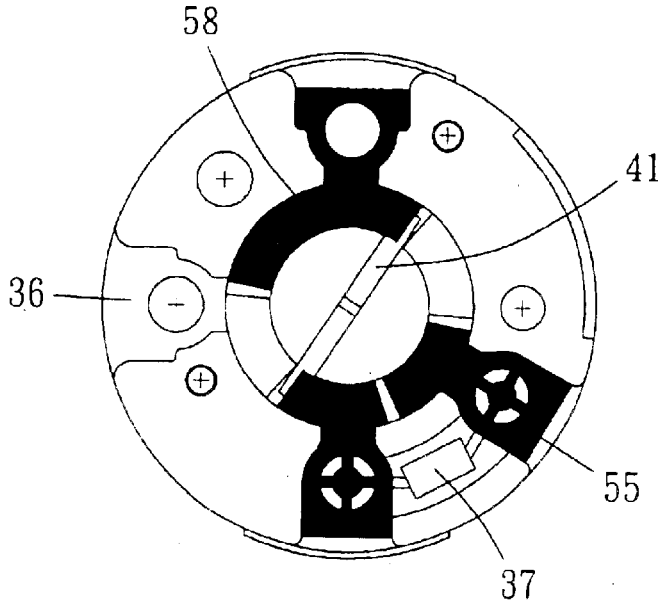
FIG. 8 is an upper view of the second preferred embodiment of a second base of a chain-controlled lamp stand with multi-stage light modulation in the present invention, showing the circuit completely connected in the second base.
Figure 9:
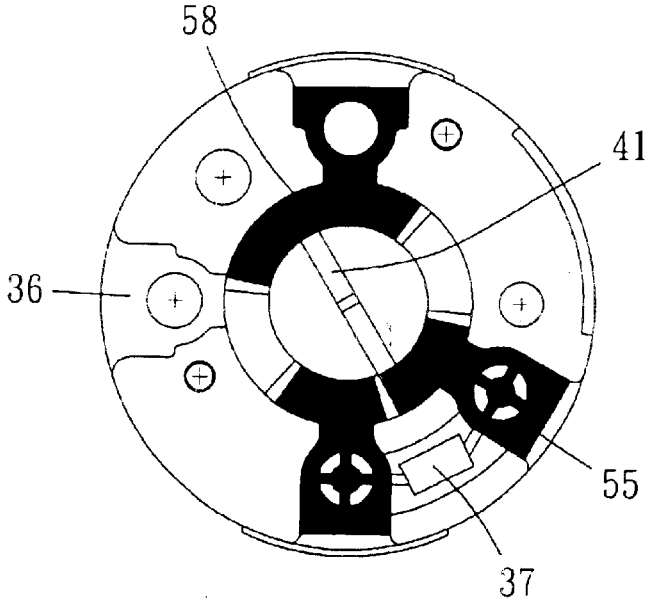
FIG. 9 is an upper view of the second preferred embodiment of the second base of a chain-controlled lamp stand with multi-stage light modulation in the present invention, showing the circuit half-connected in the second base.
Figure 10:
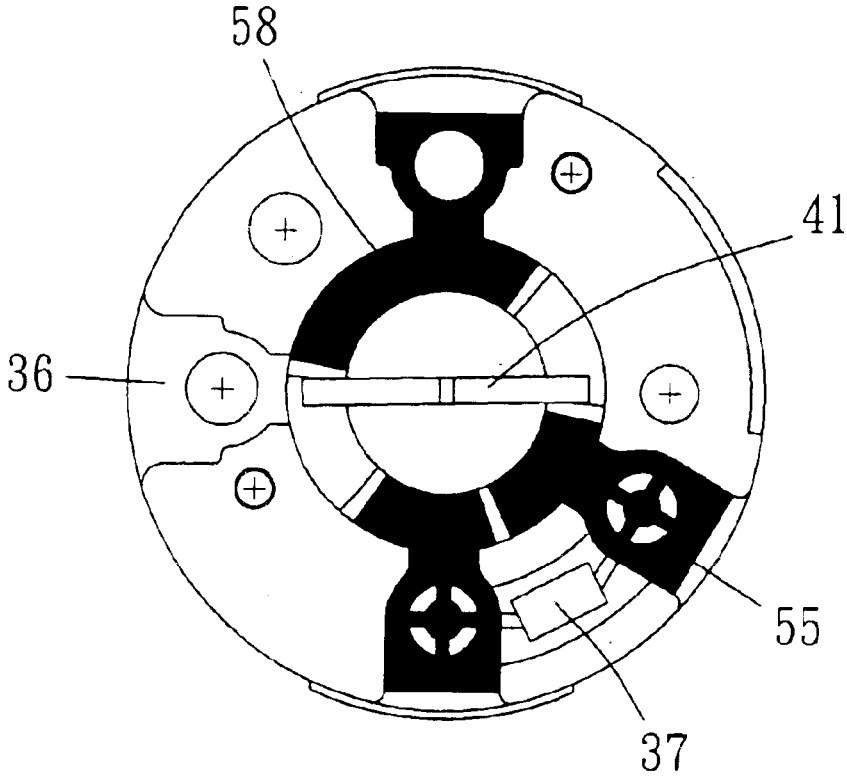
FIG. 10 is an upper view of the second preferred embodiment of the second base of a chain-controlled lamp stand with multi-stage light modulation in the present invention, showing the circuit disconnected in the second base.

A chain-controlled switch in the second preferred embodiment is composed of the rotary metal bar 41, the press reed 42, the rotatable rod 43, the pull chain 44, the rotatable disc 45, the torque spring 46, the bell-shaped base 50 and the bell-shaped member 51. When the pull chain 44 is pulled to actuate the rotatable disc 45 to rotate, the projecting teeth 450 of the rotatable disc 45 and the projecting teeth 431 of the rotatable rod 43 meshed together will actuate the rotary metal bar 41 to rotate. Thus, when the rotary metal bar 41 is rotated to different positions in the six teeth grooves 381 of the first base 38, as shown in FIGS. 8, 9 and 10, the lamp of the lamp stand will have three different conditions: a condition of high brightness, a condition of medium brightness and a condition of electric disconnection. In addition, the protruding-out end of the torque spring 46 is able to force the rotatable disc 45 to quickly recover its original position after the rotatable disc 45 is turned around, enabling the chain-controlled switch to be operated repeatedly.

According to the above-mentioned device in the second preferred embodiment, the conditions of multi-stage light modulation of the lamp stand are described as follows.

Figure 11:
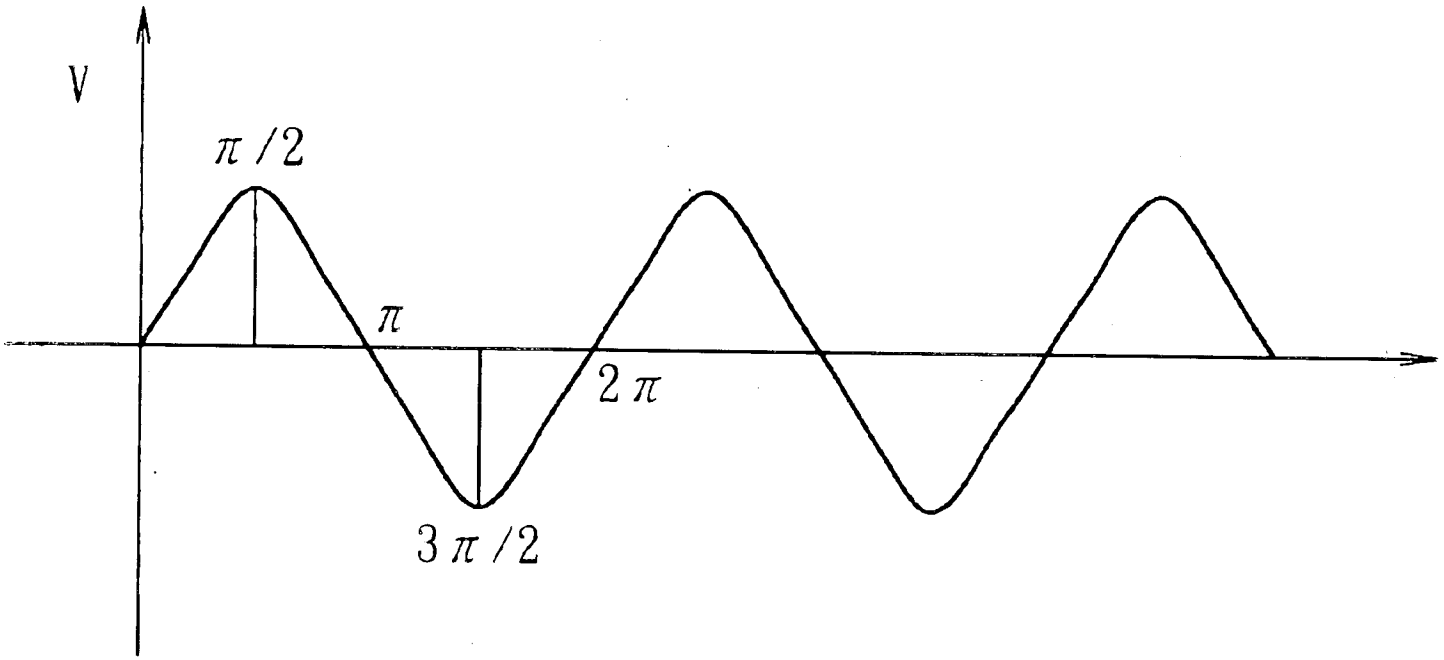
FIG. 11 is a graph of the voltage waveform of the second preferred embodiment of the second base of a chain-controlled lamp stand with multi-stage light modulation in the present invention, showing the current completely connected in the second base.

(A). A condition of high brightness: when the rotary metal bar 41 in the first base 38 is turned to a first position as shown in FIG. 8, two electrodes of the power are respectively and directly connected with two electrodes of the lamp to supply two ends of the lamp with a voltage as shown in FIG. 11, letting the lamp shine brightly.

Figure 12:
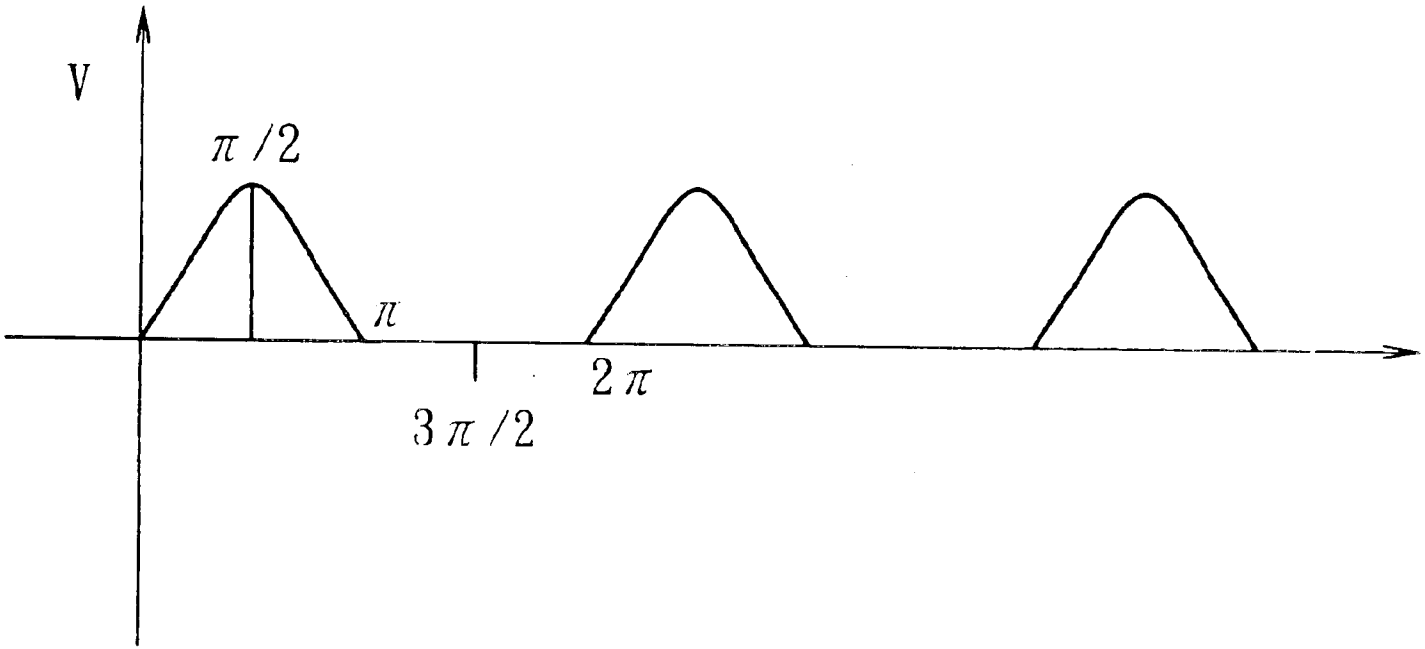
FIG. 12 is a graph of the voltage waveform of the second preferred embodiment of the second base of a chain-controlled lamp stand with multi-stage light modulation in the present invention, showing the circuit half-connected.

(B). A condition of medium brightness: when the rotary metal bar 41 in the first base 38 is turned to a second position as shown in FIG. 9, the two electrodes of the power, after passing through the diode 37 and intercepting wave, will respectively connected with the two electrodes of the lamp to supply two ends of the lamp with a voltage as shown in FIG. 12, letting the lamp shine with middling brightness.

(C). A condition of electric disconnection: when the rotary metal bar 41 in the first base 38 is turned to a third position as shown in FIG. 10, the two electrodes of the power will be disconnected from the two electrodes of the lamp, letting the lamp fail to shine.

As can be noted from the above-description, the lamp stand of this invention can carry out multi-stage light modulation with excellent effect and has very small dimensions.

While the preferred embodiments of the invention have been described above, it will be recognized and understood that various modifications may be made therein and the appended claims are intended to cover all such modifications that may fall within the spirit and scope of the invention.

I claim:

1. A chain-controlled lamp stand with multi-stage light modulation comprising:

a circular holder for receiving a lamp, said circular holder provided with a center tongue at the bottom, said circular holder and said center tongue respectively connected with two electrodes of said lamp;

a first base and a second base assembled under said circular holder;

a light modulation circuit board assembled under said first and said second base, said light modulation circuit board provided with a multi-stage connecting strip, said connecting strip able to change and control voltage waveform, said connecting strip having the other end provided with a resistance, a DIAC, a capacitor and a TRIAC; and a chain controlled switch installed between said first base and said second base, said chain controlled switch comprising a pull chain, a rotatable disc actuated to rotate by said pull chain, a rotatable rod engaged with said rotatable disc to rotate together, said rotatable rod provided thereon with a first contact strip, said contact strip of said rotatable rod contacting with said connecting strip on said light modulation circuit board, said contact strip of said rotatable rod contacting with said connecting strip of said light modulation circuit board to control brightness of said lamp and conditions of electric connection and disconnection, said rotatable disc combined with a torque spring, said torque spring forcing said rotatable disc to recover its original position after said rotatable disc is turned around, said chain-controlled switch able to be operated repeatedly.

2. A chain-controlled lamp stand with multi-stage light modulation comprising:

a circuit holder for receiving a lamp, said circular holder provided with a center tongue at the bottom, said circuit holder and said center tongue respectively connected with two electrodes of said lamp;

a first base and a second base assembled under said circular holder, said first base having its interior formed with a groove provided with a plurality of helical teeth;

a diode provided between said first and said second base, said diode having its opposite ends respectively connected with a conjugated contact strip; and a chain controlled switch installed between said first and said second base, said chain controlled switch provided with a rotary metal bar having a compression spring on the topside, said compression spring having its upper end inserted in the through hole of a rotatable rod, said rotatable rod bored with a lateral groove at the bottom for receiving said rotary metal bar therein, said rotary metal bar resting in said helical teeth groove of said first base, a rotatable disc fitted and engaged on the upper portion of said rotatable rod, said rotatable disc actuated by a pull chain to rotate together with said rotatable rod, said rotatable rod simultaneously actuating said rotary metal bar to rotate, said lamp of said lamp stand shining with half brightness when said rotary metal bar is turned and connected with said conjugated contact strip, said lamp shining with high brightness or electrically disconnected when said pull chain is pulled again.

* * * * *